US005791169A

United States Patent [19]

Kuo

[11] Patent Number: 5,791,169

[45] Date of Patent: Aug. 11, 1998

[54] U-SHAPE LOCK

[76] Inventor: Lambert Kuo, No. 16, Lane 459, Sec. 1, An Ho Rd., Tainan, Taiwan

[21] Appl. No.: 918,128

[22] Filed: Aug. 27, 1997

[51] Int. Cl.[6] ..... E05B 37/02

[52] U.S. Cl. ..... 70/26; 70/28; 70/52

[58] Field of Search ..... 70/21–30, 52, 70/233, 311, 312, 321, 322, 326–328

[56] References Cited

U.S. PATENT DOCUMENTS

| | | | |
|---|---|---|---|
| 546,969 | 9/1895 | Bozano | 70/29 |
| 556,573 | 3/1896 | Bozano | 70/29 |
| 877,682 | 1/1908 | Turman | 70/28 |
| 970,856 | 9/1910 | Simisky | 70/29 |
| 1,034,263 | 7/1912 | Lorey | 70/28 |
| 1,117,417 | 11/1914 | Meepos | 70/29 |
| 1,146,443 | 7/1915 | Pellegrino | 70/28 |
| 1,205,781 | 11/1916 | Piróg | 70/28 |
| 4,621,509 | 11/1986 | Mizuno | 70/26 |
| 5,406,811 | 4/1995 | Nakai | 70/30 X |
| 5,560,232 | 10/1996 | Chen | 70/30 |

*Primary Examiner*—Lloyd A. Gall
*Attorney, Agent, or Firm*—Hedman, Gibson & Costigan, P.C.

[57] ABSTRACT

A U-shaped lock includes a U-shaped bar, a cross bar and a lock body mounted therein, such that a user is able to achieve a locking process by the U-shaped bar and the cross bar no matter whether the combination input by a user of the lock body coincides with the predetermined sequence.

4 Claims, 6 Drawing Sheets

U-SHAPE LOCK

FIELD OF THE INVENTION

The present invention generally relates to a lock, and more particularly to a U-shaped number-combination lock which is able to achieve a locking purpose even when input of the number-combination of the lock is not correct.

BACKGROUND OF THE INVENTION

Cyclists and motorcyclists often use a second lock to secure their bicycles or motorcycles even when there is an originally-provided one. To fulfill different requirements of locks by the users, various locks have been introduced to the market, among which, a U-shaped lock is the most popular. With the incorporation of a U-shape bar, a cross bar of the lock and a corresponding part of a frame of the bicycle or the motorcycle, the lock is able to successfully stop rotation of one of a pair of wheels, and therefore, an achievement of anti-theft is accomplished. A conventional U-shaped lock normally includes a cross bar, a locking body securely received within the cross bar, a U-shaped bar movably connected with the cross bar and a stop pivotally received within the locking body. When a user is trying to lock the U-shaped lock, he/she may insert a proper key into the locking body and then rotate the key to drive the stop to securely engage with a peripherally defined recess of a distal end of the U-shaped bar. When the user is trying to unlock the U-shaped lock, he/she still needs the key to disengage the stop from the recess of the U-shaped bar. Although, such a U-shaped lock is able to achieve the purpose of anti-theft, it still is not convenient for the user, since the user needs a specific key every time to drive the stop to engage or disengage with the recess of the distal end of the U-shaped bar. That is, if the key is lost, the user is unable to lock and/or unlock the U-shaped lock.

To solve the inconvenience of need of a key, a U-shape lock with a number-combination body securely received therein has been disclosed, so that the user will no longer need a key to lock/unlock the U-shape lock. However, such a U-shaped lock still suffers several disadvantages, such as:

1. The number-combination body should be securely received within the cross bar of the U-shape lock, however, the products presented in the market use positioning pins to secure the number-combination body, which does not secure the number-combination body sufficiently within the cross bar and does not fulfill the requirement of rigid location of the user.

2. Because the U-shape lock will be locked/unlocked only the sequence of the combination is correct, therefore, the user will have to pay close attention to the combination, which causes a lot of trouble to the user.

3. To securely fix the number-combination body within the cross bar, the manufacturer will have to use rivets or the like to accomplish the purpose, which increases labor costs.

From the previous description, it is noted that to fully solve the aforementioned problems, alternatives and/or improvement(s) to the conventional U-shaped lock are thus required. A U-shaped lock constructed in accordance with the present invention tends to mitigate and/or obviate the aforementioned problems.

SUMMARY OF THE INVENTION

In accordance with one aspect of the invention, the main objective of the invention is to provide a U-shaped lock which enables a user to function a locking process even when input of sequence does not conform to the predetermined sequence.

Another objective of the invention is to provide a U-shaped lock having a simple structure which enables manufacturers to save time and costs in assembly of all the parts.

Other objects, advantages and novel features of the invention will become more apparent from the following detailed description when taken in conjunction with the accompanying drawings.

BRIEF DESCRIPTION OF THE DRAWINGS

The present invention will now be better understood with reference of the accompanying drawings wherein.

DETAILED DESCRIPTION OF THE PREFERRED EMBODIMENT

Figure 1:
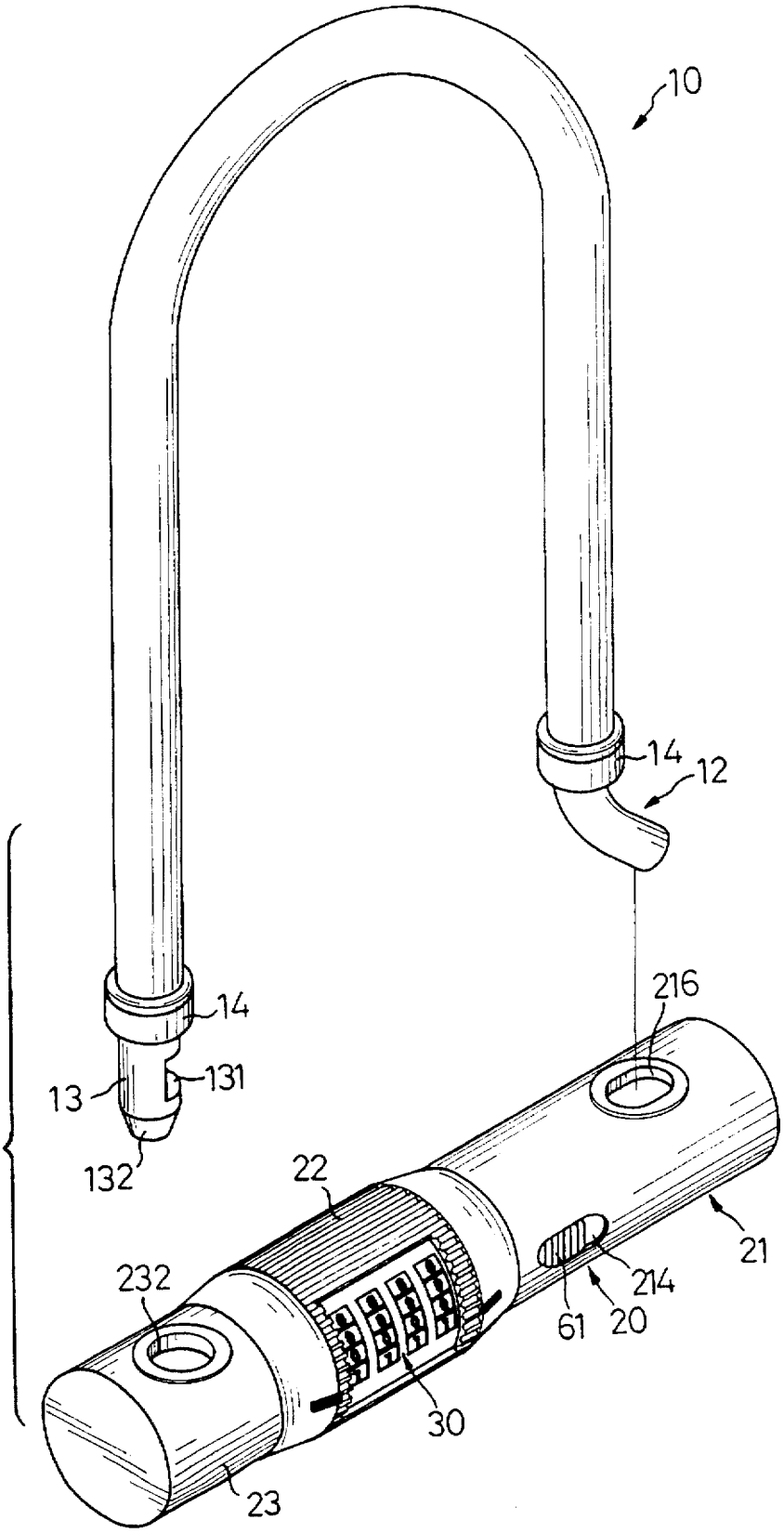
FIG. 1 is a perspective view of a U-shaped lock constructed in accordance with the present invention.

Referring to FIG. 1, one preferred embodiment of a U-shaped lock constructed in accordance with the present invention is shown. The embodiment intends in descriptive purpose and not in any form to limit the scope of the present invention, such that the features of the present invention also apply to various forms of U-shaped lock.

In the preferred embodiment of FIG. 1, the U-shaped lock of the invention includes a U-shaped bar 10 and a cross bar 20. A first end 12 of the U-shaped bar 10 extends outward and a second end 13 thereof defines therein a trough 131. The second end 13 is configured to have a cone head 132 formed on a distal end thereof. Both first end 12 and second end 13 are respectively provided with a cushion 14 mounted there around, so that rain or the like will not flow into and subsequently damage internal parts of the cross bar 20 when assembled therewith.

Figure 2:
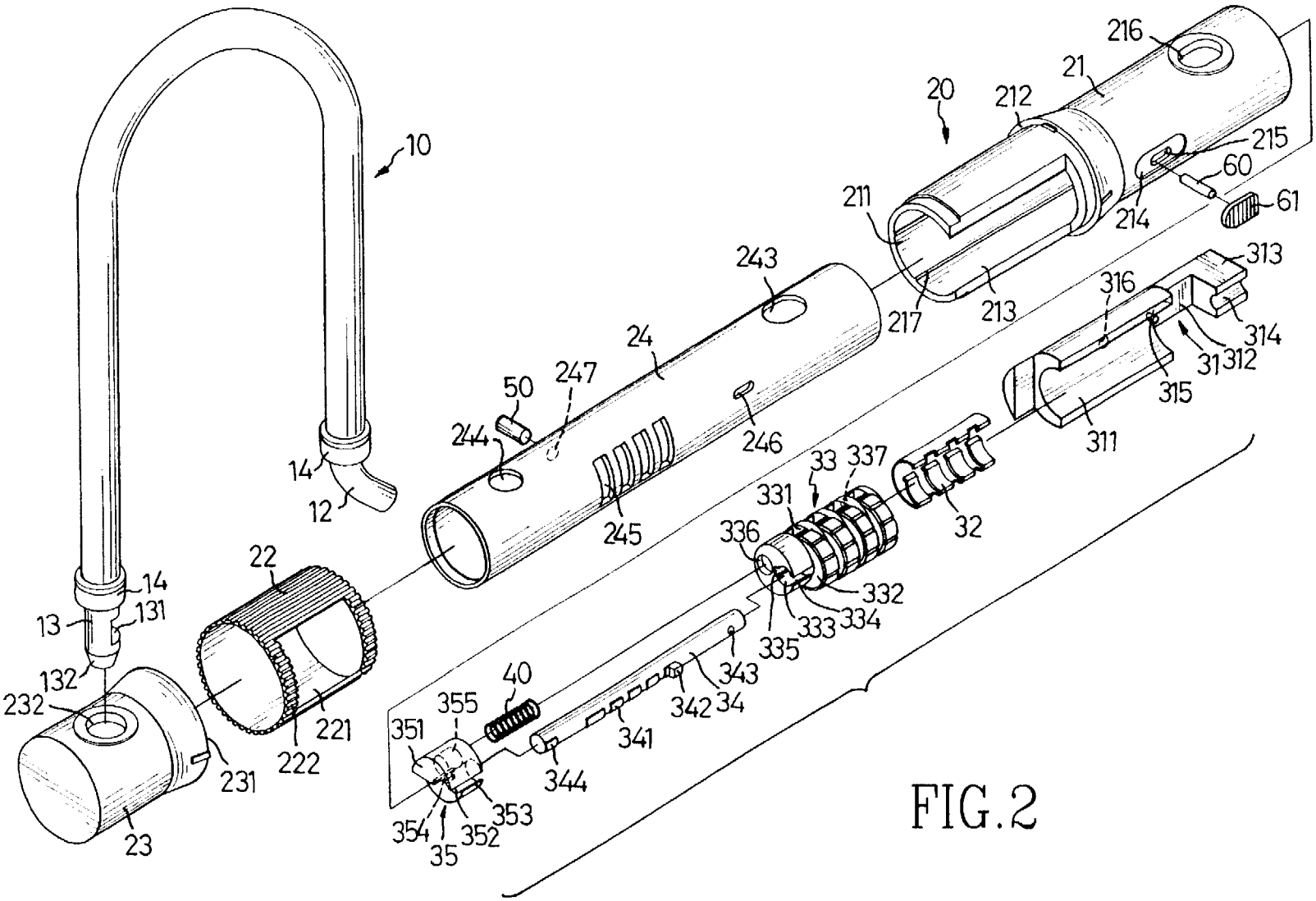
FIG. 2 is an exploded view of the U-shaped lock as shown in FIG. 1.

Referring to FIGS. 1 and 2, the cross bar 20 includes an outer tube 21 and an inner tube 24 partially and fixedly received within the outer tube 21. The outer tube 21 has a blind end (not numbered) and an open end 211. A shoulder 212 is circumferentially formed at a predetermined position on an outer periphery of the outer tube 21. Furthermore, a first cutout 213 defined and extended between the open end 211 and the shoulder 212 thereof, a first recess 214 having a first hole 215 defined therein and a locking hole 216 are all defined in a periphery of the outer tube 20. A plurality of ribs 217 are integrally formed on an inner periphery of the outer tube 20, such that when the inner tube 24 is inserted into the outer tube 21, the ribs 217 will securely abut an outer periphery of the inner tube 24.

A protection ring 22 having a window 221 peripherally defined therein and a plurality of serrations 222 integrally formed on an outer periphery thereof is able to receive a part of the outer tube 21 and abuts against the shoulder 212 of the outer tube 21. A positioning tube 23 having a blind end and an open end 231 is able to enclose the open end 211 of the outer tube 21 and defines therein a locking hole 232 for receiving the second end 13 of the U-shaped bar 10 therein.

The inner tube 24 has two through holes 243, 244 respectively and peripherally defined in positions corresponding to the locking hole 216 of the outer tube 21 and the locking hole 232 of the positioning tube 23, a grid 245, a slot 246 and an opening 247 are also defined in a periphery thereof.

A lock body 30 is securely received within the inner tube 24 and includes a positioning device 33, a resilient plate 32 mounted onto the positioning device 33, a positioning seat 31 receiving the positioning device 33 and the resilient plate 32 therein, a shaft 34 movably received within the positioning device 33 and a locking block 35 securely mounted onto a distal end of the shaft 34.

The positioning seat 31 defines therein a second cutout 311 and has an extension 312 fixedly connected with a periphery of the second cutout 311 and a protrusion 313 extending outward from the extension 312 and having defined therein a third cutout 314. Furthermore, the positioning seat 31 has a depression 316 defined therein and a boss 315 extending therefrom.

The positioning device 33 is a cylindrical form and defines therein a plurality of substantially parallel and spaced apart grooves 331 for respectively receiving corresponding rollers 332 therein. A longitudinal channel 333 is defined within the positioning device 33 and a fourth cutout 334 in communication with the channel 333 is defined in a front end thereof. A positioning recess 335 in communication with the channel 333 and opposite to the fourth cutout 334 is also defined in the positioning device 33. A second recess 336 is defined adjacent to the positioning recess 335 and opposite to the fourth cutout 334. Furthermore, there are a plurality of nicks (not labeled or shown) provided on each of the rollers 332, such that the resilient plate 32 is able to maintain the rollers 332 securely onto the positioning device. A second hole 337 is defined in a periphery of the positioning device 33. Also, each of the rollers 332 has a gap (not shown or labeled) defined therein. Therefore, when each of the gaps is aligned with the channel 333, the shaft 34 is able to be inserted therethrough. Since the function of the resilient plate 32 and the alignment of the gaps of each of the rollers 332 with the channel 333 are well known in the art, detailed description thereof is omitted.

The shaft 34 has a plurality of aligned driving blocks 341 integrally formed on a periphery thereof, a stop 342 formed adjacent to one of the driving blocks 341, a third hole 343 defined in a first distal end thereof and a block 344 formed on a second distal end thereof.

Figure 3:
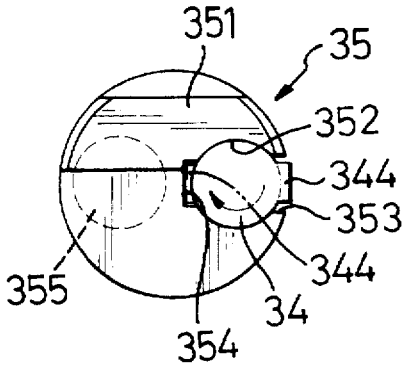
FIG. 3 is a schematic view showing an interaction between a block and a rod of a numbered body.

The cylindrical locking block 35, referring to FIGS. 2 and 3, has a locking end 351, a fifth cutout 352 defined therein, a third recess 353 defined in a periphery of the fifth cutout 352 and in communication with the fifth cutout 352, and a seat 354 defined adjacent the locking end 351 and opposite the fifth cutout 352. The locking block 35 further has a blind hole 355 defined therein and corresponding to the second recess 336 of the positioning device 33, such that a coil spring 40 can extend between the second recess 336 and the blind hole 355.

In assembly, the block 344 of the shaft 34 is firstly inserted into the third recess 353 of the locking block 35, whereafter, until the block 344 extends out from the third recess 353, the shaft 34 is able to be rotated 180° and the block 344 will be securely rested on the seat 354. Meanwhile, after each gap of the rollers 332 is aligned with the channel 333, the other end of the shaft 34 including the stop 342 and the driving blocks 341 is inserted therethrough, whereafter until the stop 342 extends out from the positioning device 33, rotation of the shaft 34 enables the stop 342 to be securely abutted against an outer periphery of the positioning device 33. Before the rotation of the shaft 34, the coil spring 40 is securely received between the blind hole 355 of the locking block 35 and the second recess 336 of the positioning device 33. After the shaft 34 and the positioning device 33 are secured with each other, the resilient plate 32 is securely mounted onto the rollers 332 to secure the positioning device 33, after which, the positioning device 33, together with the shaft 34 and the locking block 35 are inserted into the inner tube 24, whereafter each of the rollers 332 is exposed through the grid 245. The positioning seat 31 is then inserted into the inner tube 24, such that the positioning device is rested on the second cutout 311 and the boss 315 is inserted into the second hole 337 of the positioning device 33. Since the second cutout 311 and the third cutout 314 are positioned at the same level, the positioning device 33 will also rest on the third cutout 314 and therefore has support from both the second cutout 311 and the third cutout 314.

When the positioning seat 31 is inserted into the inner tube 24, alignment of the depression 316 of the positioning seat 31 with the opening 247 of the inner tube 24 will enable a pin 50 to be inserted therethrough. The inner tube 24 is inserted into the outer tube 21 to allow the rollers 332 to be revealed from the grid 245 to be positioned in the first cutout 213, after which, the open end 211 of the outer tube 21 is inserted into the protection ring 22 and the rollers 332 are allowed to be received within the outer tube 21 to be positioned within the window 221. The opening end 231 of the positioning tube 23 is welded to the open end 211 of the outer tube 21 to close the open end 211 of the outer tube 21 and then enclose above mentioned parts. A second pin 60 having a plate 61 integrally formed therewith is inserted from the hole 215 of the outer tube 21 and into the slot 246 of the inner tube 24 and the third hole 343 of the shaft 34 to achieve the construction of the cross bar 20. At this time, if the rollers 332 are to be protected from dirt or other pollutants, a user is able to rotate the protection ring 22 to move the alignment of the window 221 with the first cutout 213.

Figure 4:
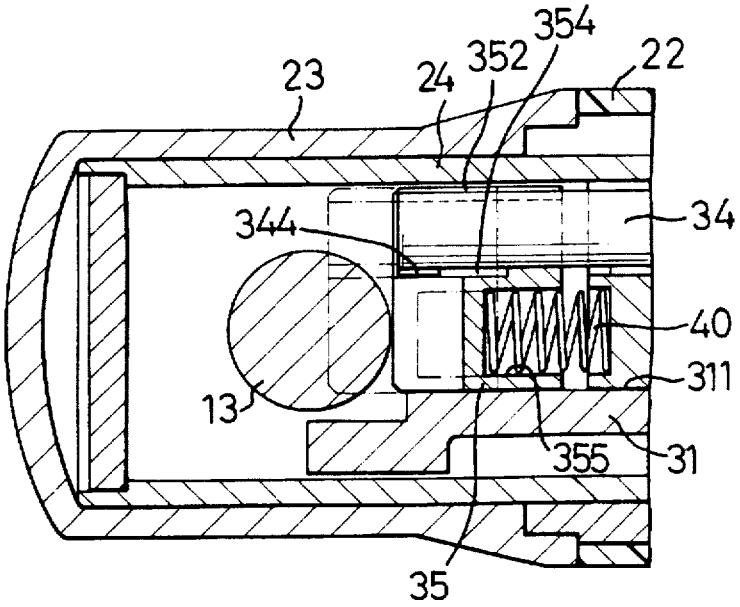
FIG. 4 is a partial cross sectional view showing that the U-shaped lock of the invention undergoes a locking process.
Figure 5:
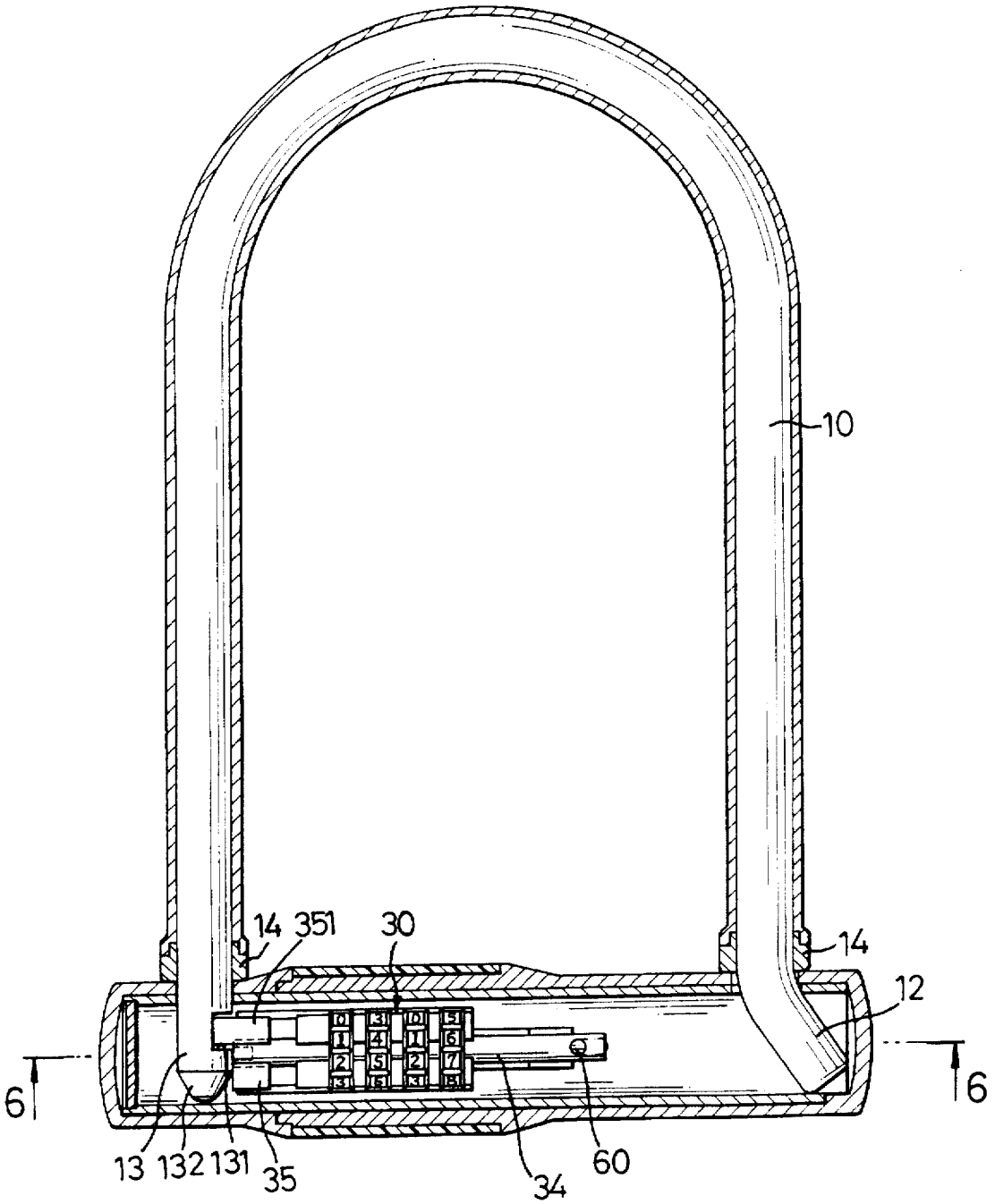
FIG. 5 is a partial cross sectional view showing a relationship between a U-shaped rod and a cross bar.
Figure 6:
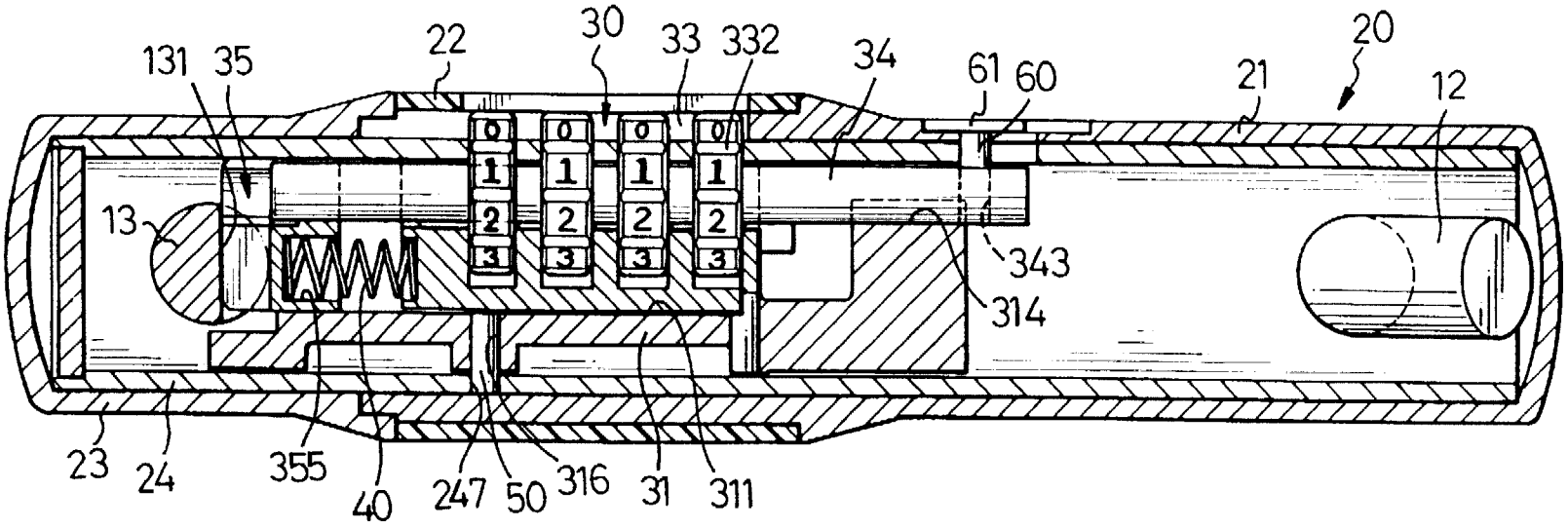
FIG. 6 is a partial cross sectional top view showing a relationship between the U-shaped rod and the cross bar when assembled.

Referring to FIGS. 4, 5 and 6, no matter whether the combination of the rollers 332 is correct or not, the U-shaped bar 10 is able to be inserted into the locking holes 216, 232, and the principle of which is described as follows.

It is to be noted that the first end 12 of the U-shaped bar 10 is firstly inserted into the locking hole 216 of the outer tube 21 and the through hole 243 of the inner tube 24. The cone head 132 of the second end 13 of the U-shaped bar 10 is inserted into the locking hole 232 of the positioning tube 23 and the through hole 244 of the inner tube 24. As the cone head 132 progresses into the locking hole 232, the locking end 351 of the locking block 35 is driven to move relative to the shaft 34, and due to the recovery force of the coil spring 40, the locking end 351 will be received within the trough 131 of the second end 13, when the trough 131 is mated with the locking end 351. Because the relationship between the trough 131 and the locking end 351 works like a clutch, the U-shaped lock of the invention can always achieve a locking purpose no matter the combination is correct or not.

Figure 7:
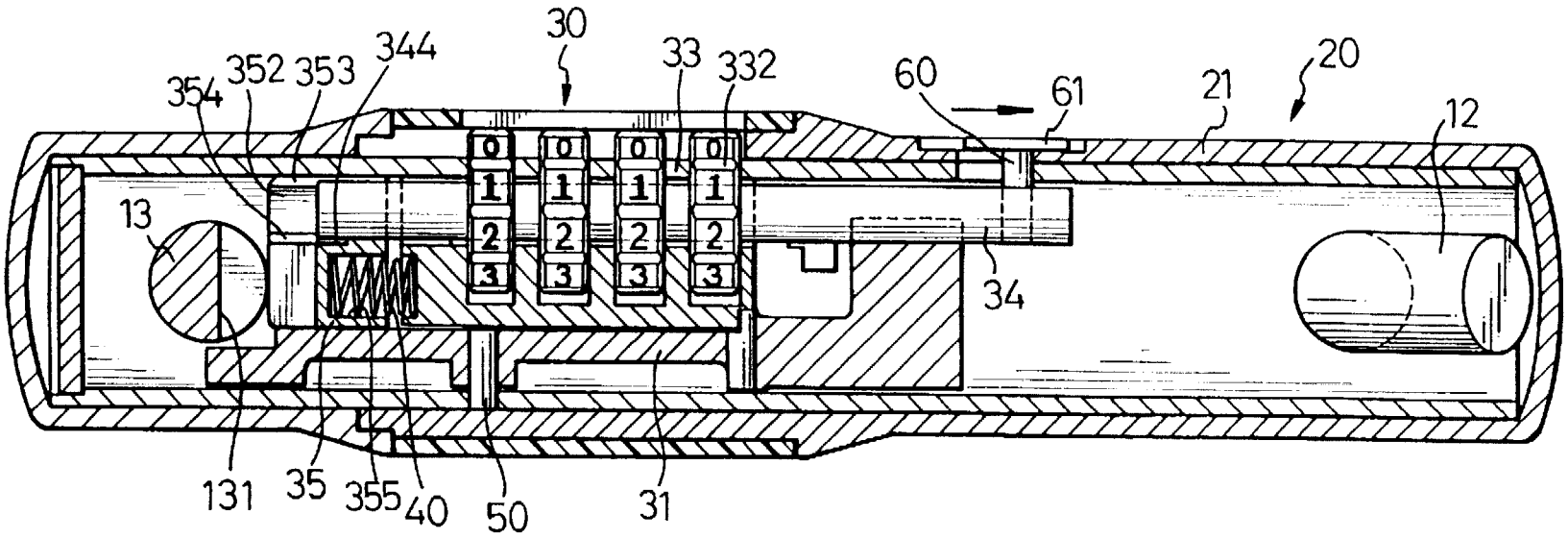
FIG. 7 is further a partial cross sectional top view showing an unlocking movement of the U-shaped lock of the present invention.

When unlocking the U-shaped lock, referring to FIG. 7, each of the rollers 332 if firstly rotated to a previously designated sequence to allow an alignment between the gaps and the positioning recess 335, the plate 61 is then moved transversely, the locking block 35 will also be moved transversely because of the insertion of the second pin 60 into the third hole 343 and the secured seated block 344 within the seat 354. Finally, the locking end 351 of the locking block 35 will leave the confinement of the trough 131 of the second end 13 of the U-shaped bar 10, and the U-shaped bar 10 is able to be lifted away from the cross bar 20, as shown in FIG. 1.

After the U-shaped bar 10 has left the cross bar 20, the locking end 351 will be pushed back to a position where it aligns with the locking hole 232 of the positioning tube 23. The U-shaped bar 10 can thus easily lock with the cross bar 20 again.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A U-shaped lock comprising:

a U-shaped bar having a first end and a second end peripherally defining therein a trough;

a cross bar having:

an outer tube provided with a plurality of ribs integrally formed in an inner periphery thereof and peripherally defining therein a locking hole, a shoulder integrally formed therewith, a first recess defined therein, a first hole defined in a periphery of said first recess and a first cutout extending between an open end thereof and said shoulder;

an inner tube securely received within said outer tube and peripherally and respectively defining therein two through holes one of which corresponds with said locking hole of said outer tube, a slot peripherally defined therein and corresponding to said first hole of said outer tube and a grid peripherally defined therein and corresponding to said first cutout of said outer tube;

a lock body securely received within said inner tube and having:

a shaft having a block integrally formed on a distal end thereof, a plurality of aligned driving blocks, a stop integrally formed therewith and a second hole defined therein and corresponding to said first hole of said outer tube;

a positioning device peripherally defining therein a plurality of substantially parallel and spaced apart grooves, a longitudinal channel defined therein for allowing said shaft to be inserted therethrough, a plurality of rollers each rotatably received within each of said grooves and respectively having a gap defined therein, a second cutout defined therein and in communication with said channel, a positioning recess defined in communication with said channel and opposite to said second cutout, and a second recess defined therein;

whereby each of said gaps is aligned with said channel, said shaft is able to be inserted through said gaps when in alignment;

a locking block having a third recess defined therein for receiving said block to be inserted therethrough, a third cutout defined therein for receiving said distal end of said shaft to be inserted therethrough, a seat defined therein and having said block of said shaft securely abutted thereto, a locking end integrally formed therewith and detachably received within said trough of said second end of said U-shaped bar and a blind hole defined therein;

a coil spring securely extending between said second recess of said positioning device and said blind hole of said locking block;

a positioning tube securely enclosing said open end of said outer tube and defining therein a locking hole corresponding to the other one of said through holes of said inner tube; and a pin securely inserted into said first hole of said outer tube and said second hole of said shaft.

2. The U-shaped lock as claimed in claim 1 further has a protection ring defining therein a window corresponding to said grid of said inner tube and said first cutout of said outer tube.

3. The U-shaped lock as claimed in claim 1 further comprising a positioning seat having a third cutout defined therein for receiving said positioning device to be rested therein.

4. The U-shaped lock as claimed in claim 1, wherein said inner tube further defines therein an opening aligned with a third hole peripherally defined in said positioning device in a way that a second pin is able to be inserted therethrough to secure said positioning device within said inner tube.

* * * * *